United States Patent [19]

McKenna et al.

[11] Patent Number: 4,835,538

[45] Date of Patent: May 30, 1989

[54] THREE RESONATOR PARASITICALLY COUPLED MICROSTRIP ANTENNA ARRAY ELEMENT

[75] Inventors: Daniel B. McKenna, Broomfield; Todd A. Pett, Longmont, both of Colo.

[73] Assignee: Ball Corporation, Muncie, Ind.

[21] Appl. No.: 3,642

[22] Filed: Jan. 15, 1987

[51] Int. Cl.[4] ..... H01Q 1/38

[52] U.S. Cl. ..... 343/700 MS

[58] Field of Search ..... 343/700 MS, 829, 830, 343/846

[56] References Cited

U.S. PATENT DOCUMENTS

| | | | |
|---|---|---|---|
| 4,218,682 | 8/1980 | Yu | 343/700 MS |
| 4,316,194 | 2/1982 | DeSantis et al. | 343/700 MS |
| 4,623,893 | 11/1986 | Sabban | 343/700 MS |

FOREIGN PATENT DOCUMENTS

| | | | |
|---|---|---|---|
| 0207029 | 12/1986 | European Pat. Off. . | |
| 0093305 | 7/1980 | Japan | 343/700 MS |
| 0207703 | 11/1984 | Japan | 343/700 MS |
| 2046530 | 11/1980 | United Kingdom | 343/700 MS |

*Primary Examiner*—Rolf Hille
*Assistant Examiner*—Doris J. Johnson
*Attorney, Agent, or Firm*—Gilbert E. Alberding

[57] ABSTRACT

A three resonator capacitively coupled microstrip antenna structure includes an inverted stacked array of elements with a lowermost driven element directly connected to a transmission line connector, and passive elements stacked above the driven element and separated from the driven element and from one another by dielectric layers. The dimensions, spacings and quality factors of the elements are chosen so that at least one, and possibly two elements are resonant at any given frequency within a desired frequency operating range. The resulting antenna structure offers very broad bandwidth at relatively low VSWR in a compact, rugged package. The manner in which parameters of the stacked antenna structure are specified to achieve desired VSWR bandwidth and radiation efficiency is also described.

35 Claims, 6 Drawing Sheets

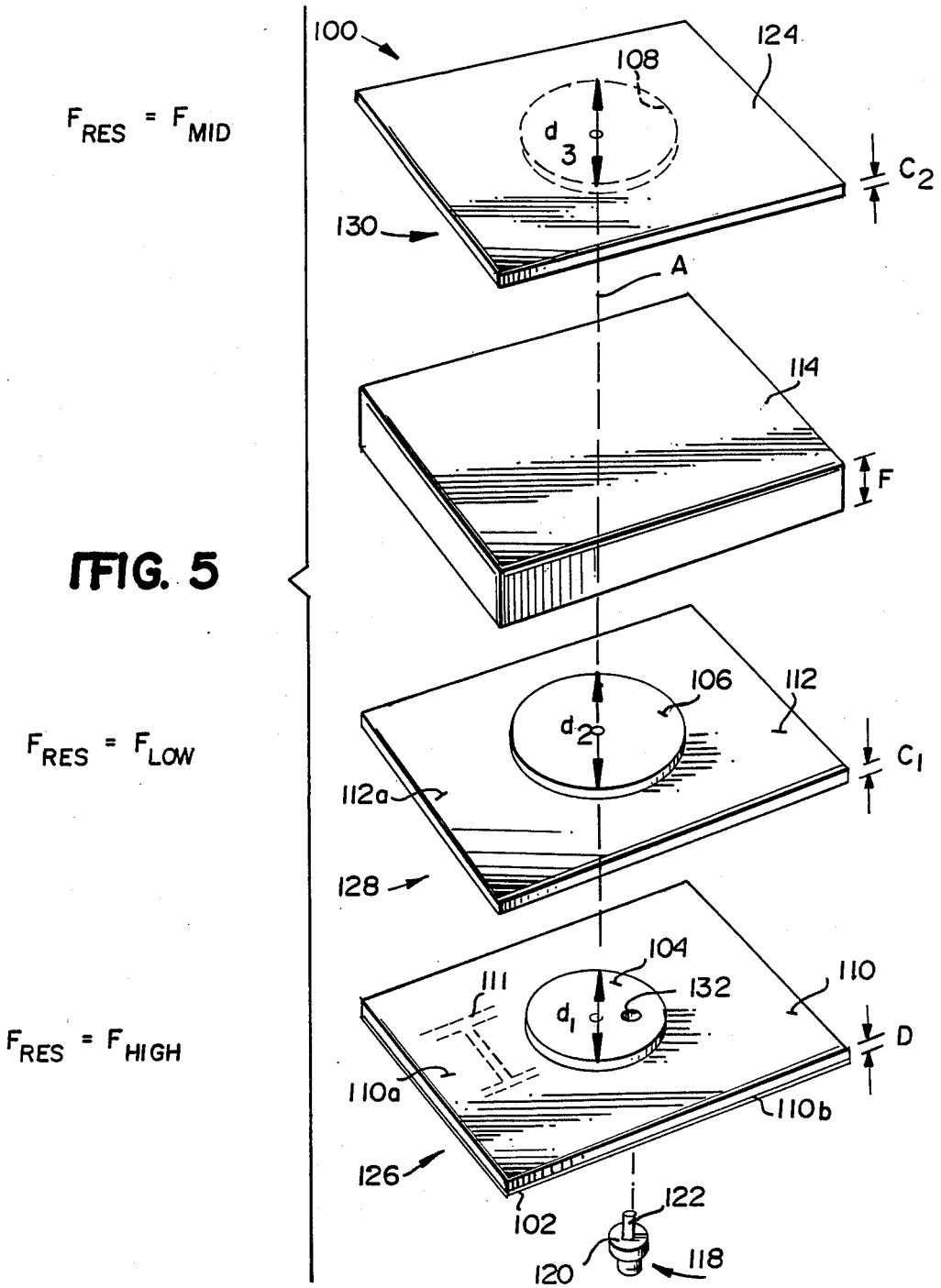
FIG. 5
FIG. 6(A)
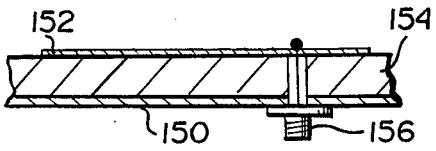
FIG. 6(B)
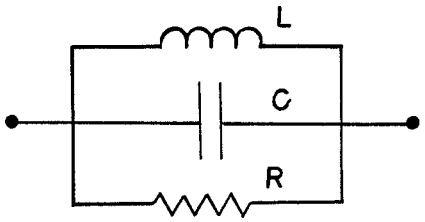

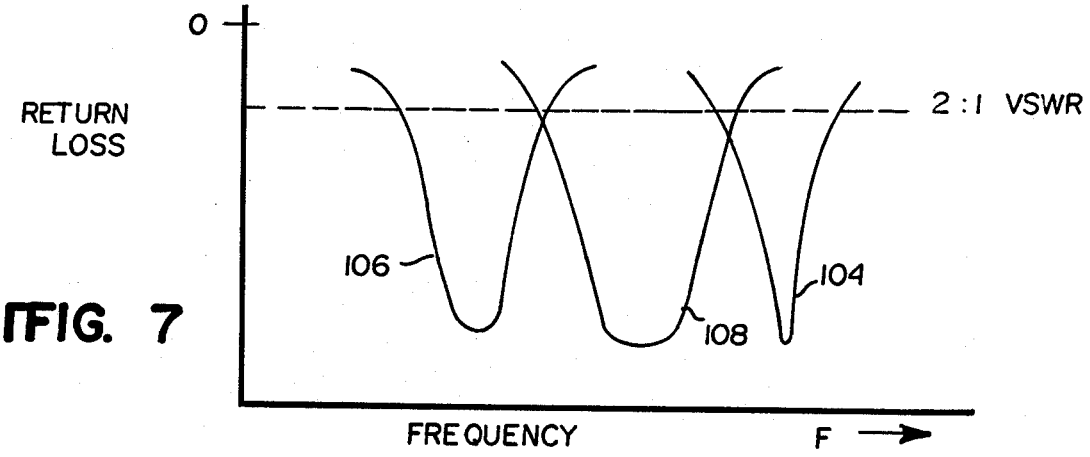
FIG. 7
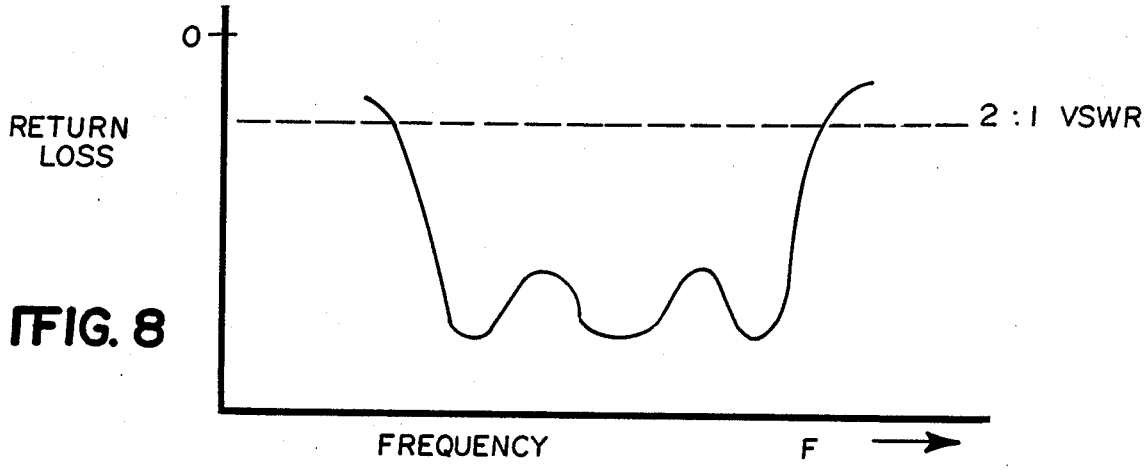
FIG. 8
FIG. 9
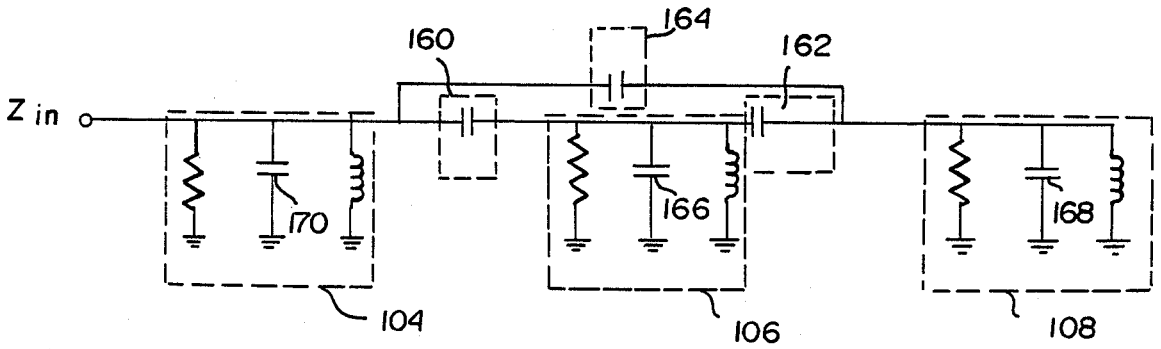

THREE RESONATOR PARASITICALLY COUPLED MICROSTRIP ANTENNA ARRAY ELEMENT

FIELD OF THE INVENTION

The present invention generally relates to microstrip antennas for transmitting and/or receiving radio frequency signals, and more particularly, to techniques for broadening and optimizing microstrip antenna bandwidth. Still more particularly, the present invention relates to broadband microstrip antennas having stacked passive and driven elements.

BACKGROUND OF THE INVENTION

Microstrip antennas of many types are now well-known in the art. Briefly, microstrip antenna radiators comprise resonantly dimensioned conductive surfaces disposed less than about one-tenth of a wavelength above a more extensive underlying conductive ground plane. The radiator elements may be spaced above the ground plane by an intermediate dielectric layer or by suitable mechanical standoff posts or the like. In some forms (especially at higher frequencies, such as UHF), the microstrip radiators and interconnecting microstrip RF feedline structures are formed by photochemical etching techniques (like those used to form printed circuits) on one side of a doubly clad dielectric sheet, with the other side of the sheet providing at least part of the underlying ground plane or conductive reference surface.

Microstrip radiators of many types have become quite popular due to several desirable electrical and mechanical characteristics. However, microstrip radiators naturally tend to have relatively narrow bandwidths (e.g., on the order of 2–5% or so). This natural characteristic sometimes presents a considerable disadvantage and disincentive to the use of microstrip antenna systems.

For example, there is considerable demand for antennas in the L-band frequency range which covers both of the global positioning satellite (GPS) frequencies L1 (1575 MHz) and L2 (1227 MHz). It may also be desirable to include the L3 frequency (1381 MHz) to enable the system to be used in either a global antenna system (GAS) or in G/AIT IONDS program. As may be appreciated, if a single antenna system is to cover both bands L1 and L2, the required bandwidth is on the order of at least 25% (e.g., $\Delta F$ divided by the midpoint frequency).

Although microstrip radiating elements have many characteristics (e.g., physical ruggedness, low cost, and small size) that might make them attractive for use in such a medium bandwidth situation, available operating bandwidths for a given microstrip antenna radiator have typically been much less than 25%—even when "broadbanded" by use of prior art techniques.

Various ways to "broadband" a microstrip antenna assembly are known. For example, related copending, commonly-assigned application Ser. No. 864,854 of Paschen filed May 20, 1986 discloses a microstrip antenna which is broadbanded by optimizing the inductive and capacitive reactances of the antenna feedline.

Previous attempts at producing a broadband microstrip antenna array element generally followed two basic approaches: (1) the thick substrate microstrip patch; and (2) the single capacitively-coupled resonator radiator.

The thick substrate microstrip patch 10 (shown in prior art FIG. 1) includes a relatively thick dielectric substrate 12 which separates the patch ground plane 14 from the radiating patch 16 (and thus defines a cavity of relatively large dimension between the two patches). A coaxial feedline connection 18 has its ground conductor connected to ground plane patch 14 and its center conductor connected to patch feed pin(s) 20. Feed pin(s) 20 pass through substrate 12 and conduct RF between connection 18 and radiating patch 16.

The thick substrate patch shown in FIG. 1 has a practical maximum bandwidth of 12%–15% at 2.0:1 VSWR (voltage standing wave ratio). In order to achieve this bandwidth performance, however, two feed pins **20*a* and 20*b* are required to ensure cancellation of the cross-polarized component and maximize radiation efficiency. Inclusion of these feed pins 20 (and associated required phasing circuitry 22**) severely limits the practical use of the thick substrate patch design in antenna arrays, since the fabrication process is complicated, and structural strength and reliability are compromised.

Concerns over reliability and production cost rule out the use of the feedthroughs necessary for thick substrate elements, at least for antenna structures which are to be mass produced and/or used in harsh environments or critical applications. Dual linear or circularly polarized operation of thick substrate elements aggravates these cost and reliability problems, since an orthogonal pair of feed connections are required—resulting in a total of four feed pins per patch.

The single capacitively coupled element 30 shown in prior art FIG. 2 eliminates the need for direct feedthrough connections. The driven patch 32 is fed by microstrip circuitry (not shown) printed on the driver substrate 34 and directly connected to the driven patch. Energy radiated by driven patch 32 excites a parasitic element 36 separated from the driven patch by a foam dielectric spacer 38. Parasitic element 36 and driven patch 32 have slightly different resonant frequencies—resulting in a broadbanding effect.

The structure shown in FIG. 2 has a bandwidth which is comparable to that of the structure shown in FIG. 1, is very easy to fabricate (for example, the three layers may be laminated together), and is also easily adapted to varying polarization requirements. Unfortunately, the maximum bandwidth of the FIG. 2 structure is only about 14% at 2:1 VSWR. While this bandwidth is sufficient for certain applications, greater bandwidth is often required.

It is possible to increase the bandwidth of the structure shown in FIG. 2 to up to about 18% bandwidth by providing ½ wavelength matching stubs. Unfortunately, the matching circuitry takes up a substantial amount of substrate real estate, increasing the size of the antenna structure. Moreover, the average VSWR of such a structure has been calculated and experimentally verified to be about 1.9:1—which is too high for the output stages of many RF transceivers and also results in inefficiency due to excessive transmission line return loss.

Some non-exhaustive examples-of prior art techniques for achieving a broadened bandwidth microstrip antenna are illustrated by the following prior issued U.S. patents:

U.S. Pat. No. Re 29,911—Munson et al (1979)

U.S. Pat. No. 4,070,676—Sanford (1978)

U.S. Pat. No. 4,180,817—Sanford (1979)
U.S. Pat. No. 4,131,893—Munson et al (1978)
U.S. Pat. No. 4,160,976—Conroy (1979)
U.S. Pat. No. 4,259,670—Schiavone (1981)
U.S. Pat. No. 4,320,401—Schiavone (1982)
U.S. Pat. No. 4,329,689—Yee (1982)
U.S. Pat. No. 4,401,988—Kaloi (1983)
U.S. Pat. No. 4,445,122—Pues (1984)
U.S. Pat. No. 4,477,813—Weiss (1984)
U.S. Pat. No. 4,529,987—Bhartia et al (1985)

See also Sanford, "Advanced Microstrip Antenna Development", Volume I, *Technology Studies For Aircraft Phased Arrays,* Report No. FAA-FM-80-11-Vol-1; TSC-FAA-80-15-Vol-1 (June, 1981).

As discussed in some of the prior art references cited above—particularly in commonly-assigned U.S. Pat. No. 4,070,676 to Sanford—the typical 2–5% natural bandwidth of a microstrip radiator can be increased somewhat by stacking multiple radiators of various sizes above the ground plane parallel to one another and parallel to the ground plane. In one embodiment disclosed in the Sanford patent (and shown in prior art FIG. 3 of the subject application), elements 40,42 of different sizes are spaced apart from the ground plane surface 44 (and from one another) by layers of dielectric material 46,48. The largest element 40 is located nearest the ground plane, with successively smaller elements being stacked in the order of their resonant frequencies.

The topmost of Sanford's elements (42) is driven with a conventional microstrip feedline 50, while element 40 disposed between the topmost element and the ground plane remains passive. Mutual coupling of energy between the resonant and non-resonant elements causes the parasitic elements to act as extensions of the ground plane and/or radio frequency feed means. The resulting compact multiple resonant radiator exhibits a potentially large number of multiple resonances with very little degradation of efficiency or change in radiation pattern.

Others have also designed stacked microstrip antenna structures. For example, the Kaloi patent discloses a coupled multilayer microstrip antenna having upper and lower elements tuned to the same frequency in an attempt to provide enhanced radiation at angles closer to the ground plane.

The Yee patent discloses a broadband stacked antenna structure having three discoid elements stacked above a ground plane in order of decreasing size. A coaxial cable center conductor is electrically connected to the top conducting plane. Yee also provides openings through his intermediate elements (supposedly to increase coupling of energy between the stacked elements). The Yee patent claims that the bandwidth of this structure is "at least as great as 6%, and possibly higher, even up to 10%." As can be appreciated, this bandwidth is insufficient for many applications.

It would be highly desirable to produce a rugged, efficient, easy to fabricate, broadband, dual linearly polarized, microstrip antenna array element that does not require a separate impedance matching circuit or feedthrough connections between layers, and yet provides a 2.0:1 VSWR bandwidth of at least 18%.

SUMMARY OF THE INVENTION

The present invention provides a composite structure antenna element including stacked radiators which may be etched on low loss microwave substrates. Broadband impedance and radiation characteristics are obtained by using three or more microstrip patch elements that have individual resonances which are slightly offset from one another. Substrate thicknesses and radiation resonances are selected to provide an average input VSWR from 1.4:1 to 2.0:1 (18% bandwidth to 25% bandwidth, respectively).

The antenna structure provided by the invention is easy to fabricate, requires no feed-through connections, is highly efficient, is easily adapted to varying polarization requirements, and also may have power dividing circuitry disposed directly on one of the patch layers. The antenna structure provided by the present invention is thus ideal for numerous array applications.

Some of the salient features of the antenna structure of the present invention include:

An inverted stack of radiator elements in which the driven element is located at the bottom of the stack just above the ground plane.

Radiator elements with overlapping resonances (i.e., two elements may resonate at some frequencies).

Spacings between and dimensions of radiator elements which are selected through empirical and experimental techniques to provide high bandwidth.

Driven and passive elements which are effectively connected in series through capacitive coupling.

Passive elements which are effectively connected in parallel through capacitive coupling.

A radome uppermost layer to protect the antenna structure from the environment.

Easy and inexpensive to fabricate and mass-produce.

Only the lowermost element is driven—so that no feed through connections or special matching circuitry is required.

Smallest element is lowermost to provide room for additional RF circuitry on the same substrate.

Easily adapted to varying polarization requirements.

Highly reproducible.

Very efficient.

Ideal for arrays.

A broadbanded microstrip antenna provided by the present invention includes a conductive reference surface, and a driven conductive RF radiator element spaced typically less than 1-10th of a wavelength above the reference surface. A conductive RF feedline is connected to the driven element. A passive conductor RF radiator element is spaced above and capacitively coupled to the driven element.

The spacing between the driven and passive elements, the spacing between the driven element and the reference surface, and the dimensions of the driven and passive elements are all chosen to provide a 2:1 VSWR bandwidth of at least 20%. Bandwidths of up to 30% have been achieved for antenna structures in accordance with the present invention with a maximum VSWR of 2:1 (thicker substrates with lower dielectric constants will produce even greater bandwidths).

The driven element may resonate at a frequency which is less than the resonant frequency of the passive element.

The driven element may be disposed on a first surface of a substrate along with at least one RF circuit (e.g., a power dividing network for use in arrays). Another surface of the substrate may be disposed in contact with the reference surface so that the substrate spaces the driven element from the reference surface.

The passive elements are effectively connected in parallel. A further passive conductive RF radiator element may be spaced above and capacitively coupled to the driven element, with the resonant frequency ranges of the passive elements overlapping.

A radome may be disposed above the passive element(s).

BRIEF DESCRIPTION OF THE DRAWINGS

These and other features and advantages of the present invention may be better and more completely understood by referring to the following detailed description in conjunction with the appended drawings, of which:

FIG. 5 is an exploded side view in perspective of the embodiment shown in FIG. 4;

FIG. 6A is a side view in cross-section of a simple microstrip element;

FIG. 6B is a schematic diagram of a two-port RLC circuit/equivalent to the microstrip element shown in FIG. 6A;

FIG. 7 is a graphical illustration of the individual theoretical overlapping resonances of the antenna structure elements shown in FIG. 4;

FIG. 8 is a graphical illustration of the composite resonance of the structure shown in FIG. 4;

FIG. 9 is a schematic diagram of the lump-component equivalent circuit for the antenna structure shown in FIG. 4;

DETAILED DESCRIPTION OF PREFERRED EMBODIMENTS

Figure 1:
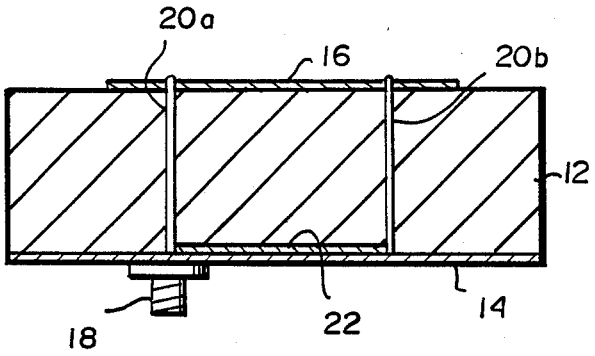
FIG. 1 PRIOR ART
FIG. 1 is a side view in cross-section of a prior art thick substrate microstrip patch.
Figure 2:
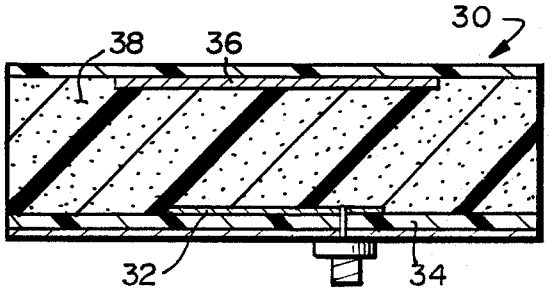
FIG.2 PRIOR ART
FIG. 2 is a side view in cross-section of a prior art single capacitively coupled microstrip radiator element.
Figure 3:
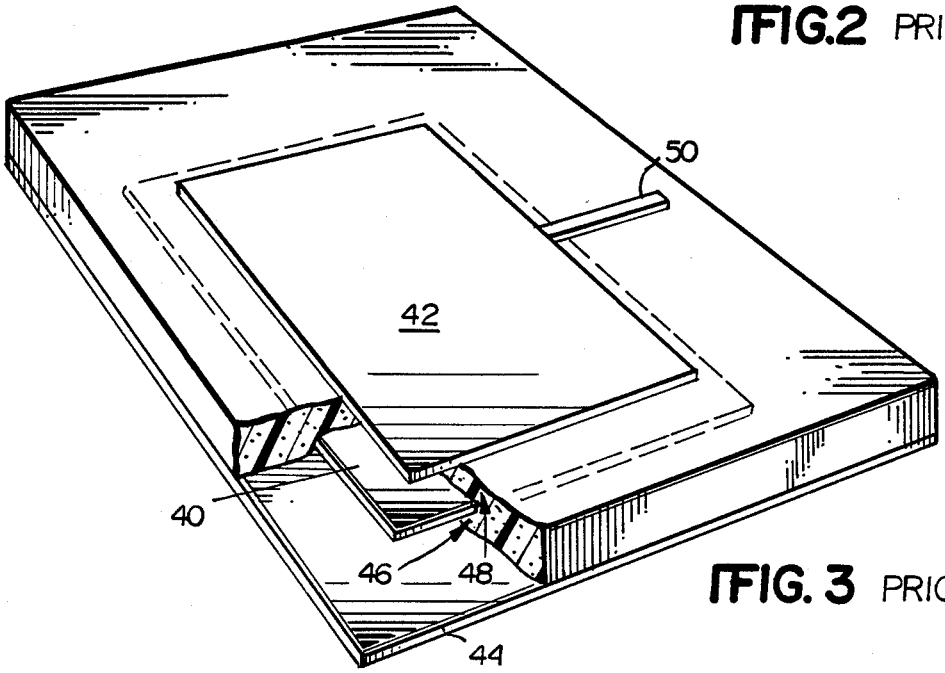
FIG. 3 PRIOR ART
FIG. 3 is an elevated side view in perspective and partial cross-section of a prior art stacked microstrip antenna structure.
Figure 4:
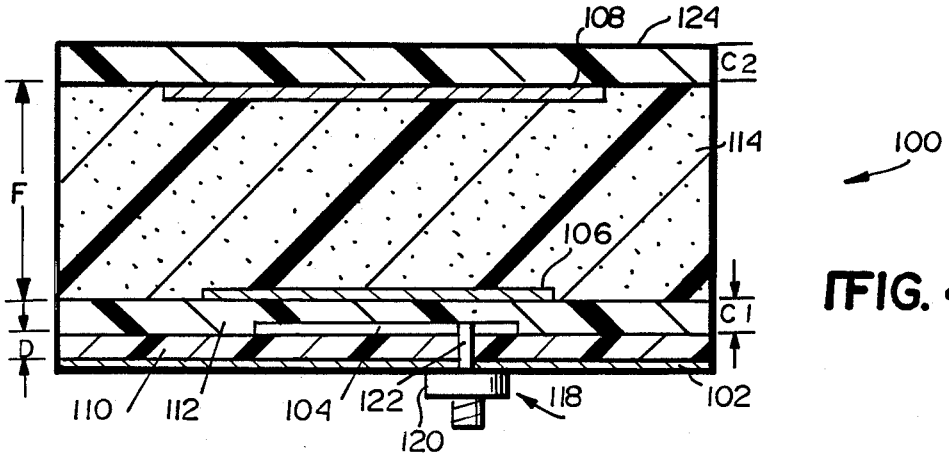
FIG. 4 is a side view in cross-section of a presently preferred exemplary embodiment of this invention.

FIG. 4 is a side view in cross-section of the presently preferred exemplary embodiment of a stacked microstrip antenna structure 100 of the present invention. Antenna structure 100 includes a conductive reference surface ("ground plane") 102, a driven element 104, a first parasitic element 106, and a second parasitic element 108. Antenna structure 100 may be termed a "three-resonator parasitically coupled microstrip antenna array element" because it includes resonant driven element 104 which is closely parasitically coupled to resonant passive elements 106 and 108.

In the preferred embodiment, ground plane 102 and elements 104, 106, 108 are stacked, and are separated from adjacent elements by layers of dielectric material. A dielectric layer 110 having a thickness D separates ground plane 102 from driven element 104; a dielectric layer 112 having a thickness C1 separates driven element 104 and first passive element 106; and a dielectric (typically foam) layer 114 having thickness F separates passive elements 106 and 108. Elements 104, 106 and 108 are each circular (discoid) in shape in the preferred embodiment (although rectangular, annular, polygonal, etc. elements could be used instead if desired).

In the preferred embodiment, driven element 104 is connected to a transmission line (not shown) via a conventional coaxial-type connector 118 (and via a microstrip if desired). Coaxial connector outer conductor 120 is electrically connected to ground plane 102, and the connector center conductor 122 passes through a hole drilled through ground plane 102 and dielectric layer 110 (without contacting the ground plane) and is electrically connected to driven element 104.

A further layer 124 of insulative material (e.g., laminate) having a thickness $C_2$ is disposed on and above passive element 108 to function as a radome—sealing antenna structure 100 from the environment and helping to prevent damage to the antenna structure.

FIG. 5 is an exploded view in perspective of antenna structure 100. Fabrication of antenna structure 100 is particularly simple in the preferred embodiment because conventional printed circuit board fabrication techniques are used. Antenna structure 100 in the preferred embodiment is fabricated by assembling five components; coaxial connector 118; a lowermost printed circuit board structure 126 (of which ground plane 102, dielectric layer 110 and driven element 104 are integral parts); a middle printed circuit board structure 128 (of which dielectric layer 112 and passive element 106 are integral parts); dielectric layer 114 (which in the preferred embodiment is a relatively thick layer of low loss foam); and an uppermost printed circuit board structure 130 (of which passive element 108 and radome layer 124 are integral parts).

Printed circuit board fabrication techniques are especially suited for microstrip antenna element fabrication because of their low cost and also because the dimensions of printed circuit board laminates as well as the size of conductive structures fabricated using such techniques are compatible with microstrip antenna structure design.

For example, in the preferred embodiment, lowermost structure 126 is fabricated from conventional doubly-clad low loss PC board stock (i.e., a sheet of laminate 110 having a sheet of copper or other conductive material adhered to its top surface 110A and another conductive material sheet adhered to its bottom surface 110B) by simply etching away (using conventional photochemical etching techniques for example) all of the copper sheet disposed on upper surface 110A except for that portion which is to form driven element 104 while leaving the cladding on bottom surface 110*b* unetched. Additional RF circuits (e.g., a power dividing network for array applications) may be etched on surface 110*a* using the same process.

Similarly, printed circuit board structures 128 and 130 are formed from low loss single-clad printed circuit board stock by etching away all of the single sheet of copper adhered thereto except for that portion which is to remain as passive elements 106, 108, respectively.

To assemble antenna structure 100, the coaxial connector center pin 122 is first pushed through a hole 132 (drilled through discoid driven element 104) which has been found beforehand (e.g., through measurement) to provide a suitable impedance match for the transmission line to be connected to connector 118. Pin 122 is conductively bonded to driven element 104 (e.g., by a solder joint or the like). Preferably, two microstrip transformers etched on surface 110*a* are also connected to pin 122 and used to rotate the antenna structure impedance locus to a nominal 50 match. The coaxial connector outer conductor is electrically bonded to ground plane 102.

Next, PC board structure 128 is placed onto upper surface 110*a* of PC board structure 126 with the center of discoid passive element 106 being aligned with the center of driven element 104. Then, foam layer 114 (which may be conventional low-loss honeycomb-type material molded to specified dimensions, or any other dielectric such as air, PTFE or the like) is disposed on an upper surface 112*a* of PC board structure 128. Finally, PC board structure 130 is disposed on foam layer 114, with discoid passive element 108 facing the foam layer and with the center of that passive element being aligned with the centers of elements 104 and 106 (so that a common axis A passes through the centers of elements 104, 106 and 108). The entire structure so assembled may be held together by applying conventional film adhesive (which can be used to coat each layer prior to assembly), and then placing the assembled structure in an autoclave.

As shown in FIGS. 4 and 5, elements 104, 106 and 108 have different dimensions. In the preferred embodiment, the diameter $d_1$ of element 104 is less than the diameter $d_2$ of element 106, which in turn is less than the diameter $d_3$ of element 108. Elements 104, 106 and 108 each have different resonant frequencies because of these differences in dimensions.

Driven element 104, being smaller than elements 106 and 108, has a resonant frequency of $f_{HIGH}$ (a frequency at or near the high end of the operating frequency range of antenna structure 100). Passive element 106 has a resonant frequency of $f_{LOW}$ (a frequency at or near the low end of the operating frequency range of antenna structure 100). Element 108 resonates at an intermediate frequency $f_{MID}$ which is between $f_{HIGH}$ and $f_{LOW}$.

Antenna structure 100 exhibits broadband performance because the quality factors (Qs) and dimensions of elements 104, 106 and 108 are chosen to provide a degree of overlap between resonant frequency ranges. That is, the sizes and spacings of driven element 104 and passive element 108 are chosen such that both of these elements resonate at some frequencies between $f_{HIGH}$ and $f_{MID}$—and similarly, spacings and dimensions of elements 108 and 106 are selected so that both of these elements resonate for some frequencies between $f_{MID}$ and $f_{LOW}$.

Briefly, the bandwidth and operating frequency range of antenna structure 100 is designed by appropriately selecting the Qs and dimensions of elements 104, and 106 and 108. The interaction between elements 104–108 is complex and the analysis used to select the spacings between the elements, the dimensions of the elements, and the dielectric constants o the intervening dielectric layers is therefore non-trivial. A detailed theoretical discussion about how these design choices are made is presented below.

It is possible to describe in simple terms the operation of antenna structure 100 as follows. Excitation of driven element 104 by an RF signal applied to the driven element via coaxial connector 118 may cause passive element 106 and/or passive element 108 to be parasitically excited (if they are resonant at the driving frequency) due to the electromagnetic fields emanating from the driven element. In a similar fashion, signals received by elements 106 and/or 108 may cause those passive elements (if they are resonant) to emanate electromagnetic fields which parasitically excite driven element 104.

The Qs of elements 104, 106 and 108 and the frequency ranges at which each of these elements resonate are selected so that, for any arbitrary frequency within the design operating frequency range of antenna structure 100, at least one and possibly two of the three elements is resonant. At some frequencies at the low end of the operating range, only element 106 is resonant. Similarly, at some frequencies in the middle of the operating range, only parasitic element 108 is resonant, and at some frequencies at the upper end of the operating range, only driven element 104 resonates. The parasitic element(s) which do not resonate at a particular frequency serve as director elements to increase antenna gain.

At some frequencies between the lower end of the operating range and the middle of the range, elements 106 and 108 may both resonate. Similarly, at some frequencies between the middle of the range and the upper end of the range, elements 104 and 108 both resonate.

Antenna structure 100 as a whole exhibits a relatively wide, virtually continuous band of resonant frequencies (see FIG. 8) that is simply not possible to achieve with one or even two microstrip elements—or with multiple elements not having the specific spacings and dimensions of the present invention.

It is helpful, in designing the spacings and dimensions of the antenna structure shown in FIG. 4, to independently mathematically model portions of the antenna structure. While the interactions between elements 104, 106 and 108 are not readily susceptible to mathematical analysis due to their complexity, each element 104, 106 and 108 may first be modelled separately (with respect ground plane 102) in order to establish initial design parameters. Then, the effects of the interactions between the elements (obtained experimentally, empirically, and/or through computer simulations) may be used to modify the design parameters resulting from the mathematical modelling to obtain desired antenna bandwidth, efficiency and frequency operating range characteristics.

The basic microstrip antenna is a resonant structure which is, in essence, a resonant cavity. FIG. 6A is a side view in cross-section of a simple microstrip antenna which includes a ground plane 150, a radiator patch 152 and a separating dielectric layer 154. A transmission line is connected between the ground plane 150 and radiator patch 152 (e.g., via a coaxial connector 156) to couple an RF signal across the antenna elements.

Element 104 and ground plane 102 of antenna structure 100 of the present invention may be modelled as one microstrip antenna; element 106 and ground plane 102 may be modelled as a second antenna; and element 108 and ground plane 102 may be modelled as a third antenna.

The simple microstrip antenna shown in FIG. 6A can be modeled by the parallel RLC circuit shown in FIG. 6B composed of fixed, lump elements. Although the parallel RLC circuit model cannot be used to predict radiation characteristics, it can be used to closely predict the input impedance characteristics of the FIG. 6A antenna with respect to the frequency (and thus, the impedance characteristics of each of elements 104, 106 and 108).

The parallel RLC circuit model has an associated quality factor "Q" which permits bandwidth and efficiency calculations to be performed. There are three bandwidth and efficiency determining quality factors for a square microstrip paths antenna: Radiation loss ($Q_R$); dielectric loss ($Q_D$); and conductor loss ($Q_R$); dielectric loss ($Q_D$); and conductor loss ($Q_C$). Assuming a rectangular microstrip element aspect ration of 1:1, radiation loss $Q_R$ is given by $$Q_r = \frac{\sqrt{\epsilon_{re}}\,\lambda_0}{2h}, \tag{1}$$

dielectric loss $Q_D$ is given by $$Q_d = \frac{1}{\tan\delta} \text{ where } \tan\delta \text{ is the dielectric loss tangent,} \tag{2}$$

and conductor loss $Q_C$ is given by $$Q_c = \frac{h}{\delta_s} \text{ where } \delta_s = \frac{1}{\sqrt{\pi f \mu_0 \sigma}}. \tag{3}$$

where $\delta_s$=skin depth f=actual frequency $\sigma$=conductivity

For a circular microstrip element, $Q_C$ and $Q_D$ are the same for both circular and square microstrip path antennas, and $Q_R$ is only slightly different.

Bandwidth is a function of overall quality factor and also of design voltage standing wave ratio (VSWR). That is, bandwidth is expressed in terms of a percentage of a desired center operating frequency over which the antenna structure exhibits a VSWR of less than or equal to a design VSWR. Bandwidth is dependent upon the following equations:

$$BW = \frac{VSWR - 1}{Q_T\sqrt{VSWR}} = \frac{\Delta f}{f} \tag{4}$$

$$\text{where } Q_T = \left[\frac{1}{Q_r} + \frac{1}{Q_d} + \frac{1}{Q_c}\right]^{-1} \tag{5}$$

The composite circuit quality factor $Q_T$ is thus always less than the lowest individual Q, and maximum theoretical bandwidth (infinite) will occur when any one Q approaches zero. However, if either $Q_D$ or $Q_C$ approaches zero, all of the available energy is absorbed and converted to heat, leaving nothing to radiate. The following equations show mathematically the interaction between the individual quality factors and the overall microstrip element radiation efficiency:

$$\eta = \frac{\text{power radiated}}{\text{power in}} = \frac{Q_L}{Q_r + Q_L} \text{ where } Q_L = \tag{6}$$

-continued $$Q_{loss} = \left[\frac{1}{Q_d} + \frac{1}{Q_c}\right]^{-1} = \frac{Q_d Q_c}{Q_d + Q_c}$$

$$\eta = \frac{1}{\frac{Q_r(Q_d + Q_c)}{Q_d Q_c} + 1} \tag{7}$$

Ideally, $Q_D$ and $Q_C$ should be high and $Q_R$ should be low—this combination maximizes the antenna impedance bandwidth and still maintains high radiation efficiency.

The individual Q parameters of the FIG. 6A antenna can be controlled by the proper selection of dielectric substrate, substrate thickness, dielectric constant, conductor metallization, conductance, and dielectric loss tangent. After physical and material selections are made, the individual quality factors are calculated and a composite $Q_T$ is then determined.

The calculated composite quality factor $Q_T$ of the microstrip element is calculated as a "black box" value—since values of the quality factors associated with the distributed inductance, capacitance and resistance of the antenna structure are very difficult to measure individually. Thus, when comparing the quality factor of a parallel RLC lump network to the composite Q of a microstrip element, the value of the individual quality factors of the microstrip element are no longer required, and the microstrip element $Q_T$ replaces the parallel RLC Qs in the lumped element model.

In order to complete the RLC modelling of the FIG. 6A antenna structure, a value of R at resonance (frequency=$F_0$) of the microstrip antenna may be calculated—or experimentally determined using network analysis of locus $S_{11}$ on a Smith Chart plot of the measured antenna impedance characteristics. The RLC model is more accurate if the resistance R of the microstrip antenna at resonance is actually measured, since the microstrip element composite quality factor $Q_T$ is calculated rather than measured. This R value may be obtained by plotting the measured impedance of the microstrip antenna on a Smith chart and noting the real impedance where the $S_{11}$ locus crosses the real axis of the Smith Chart (this is also where the resonant frequency of the microstrip antenna occurs).

By using the following circuit analysis equations, it is possible to complete the parallel RLC model derivation:

$$Q = Q_T = \text{calculated} \tag{8}$$

$$F = f_o = \text{measured } (w_o 2\pi f_o) \tag{9}$$

$$R = R_{f_o} = \text{measured} \tag{10}$$

and finally, $$C = \frac{Q}{w_0 R} \text{ and } L = \frac{R}{w_0 Q} \tag{11}$$

This model is quite accurate, and greatly simplifies the design and analysis of antenna structure shown in FIG. 4.

The following procedure may be followed to select the various design parameters for antenna structure 100 of the present invention.

First, the overall element design bandwidth, maximum VSWR, and radiation efficiency are specified. These parameters are generally design constraints associated with a particular application. For example, the efficiency and maximum VSWR of antenna structure 100 may be selected to accommodate a particular radio transceiver power output stage and/or a desired communications range or effective radiated power (ERP). Overall element bandwidth is specified according to the range of frequencies over which antenna structure 100 is to operate (for example, some common operating frequency ranges are the L band, 1.7–2.1 GHz; the S-band, 3.5–4.2 GHz; and the C-band, 5.3–6.5 GHz).

Next, proposed substrate thicknesses, dielectric constants, metallization thicknesses and loss tangents are chosen based on desired mechanical strength and desired efficiency (some of these factors may also be determined by the properties of available materials).

Then, the RLC mathematical modelling discussed above is used to calculate the $Q_R$, $Q_D$ and $Q_C$ of each of elements 104, 106 and 108 individually, and $Q_T$ is calculated for each element (using the assumption that there is no interaction between the elements).

The $Q_R$, $Q_D$ and $Q_C$ for each of elements 104, 106, 108 is calculated by evaluating equations 1–3 for the proposed substrate thickness, dielectric constant, metallization thickness and loss tangent. Then, the composite quality factor $Q_T$ for each of elements 104, 106 and 108 is calculated according to equation 5.

Finally, the individual resonant frequencies are determined (by measurement, calculation, empirical analysis and/or computer simulation) to determine the overall bandwidth and maximum VSWR of antenna structure 100.

After performing these last two steps, it may be necessary to change- the substrate parameters and iteratively recalculate antenna performance characteristics until the design specifications are satisfied. The efficiency as well as the composite $Q_T$ of each individual element is unique—and therefore, the resonant frequency separations are not linear about the "center frequency" of the overall antenna structure 100. Likewise, the efficiency of structure 100 may vary slightly with frequency, depending upon which of elements 104, 106 and 108 is acting as the primary radiator (in addition, the other elements may or may not, depending on frequency, act as directors to improve antenna gain).

Inter-element capacitances and their effects on resonant frequencies and radiation characteristics are not mentioned in the previous discussion. However, these parasitic capacitances (without which antenna structure 100 will not work as desired) are non-trivial—and more importantly, they are very difficult to model analytically. Nevertheless, it is possible to schematically describe elements 104, 106 and 108 along with their inter-element capacitances, and then determine the parasitic values empirically using computer curve fitting routines.

Figure 10:
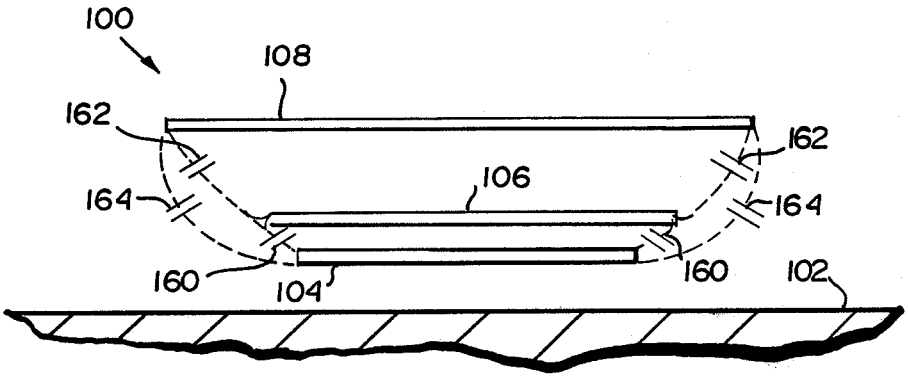
FIG. 10 is a schematic diagram of the antenna structure shown in FIG. 4 showing inter-element capacitances.

FIG. 9 is a schematic diagram of the lump-element equivalent circuit model of antenna structure 100. Each of elements 104, 106 and 108 may be modelled as a parallel RLC circuit (as described in connection with FIGS. 6A and 6B). Capacitances 166, 168 and 170 are the capacitances from elements 106, 108 and 110, respectively, to ground plane 102. Three parasitic capacitances are also included in the model shown in FIG. 9: A capacitor 160 (the parasitic capacitance between elements 104 and 106); a capacitor 162 (the parasitic capacitance between elements 106 and 108); and a capacitor 164 (the parasitic capacitance between elements 104 and 108). FIG. 10 is a schematic side view of antenna structure 100 also showing these parasitic capacitances.

Figure 11:
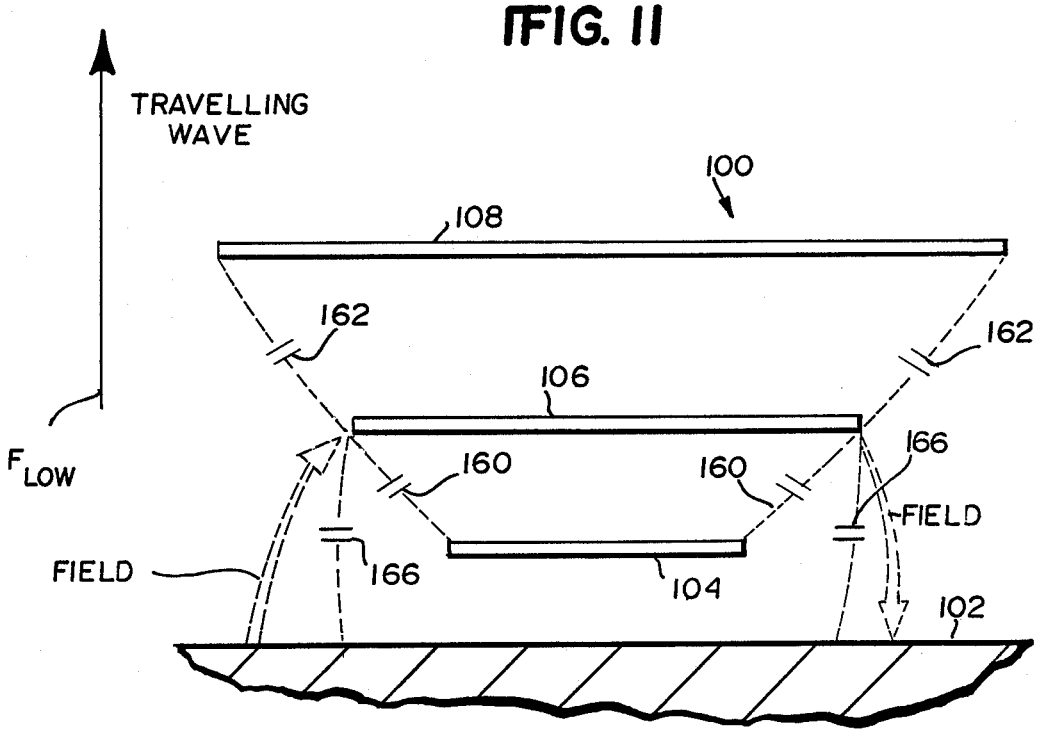
FIG. 11 is a schematic illustration of the effective inter-element capacitances which exist in the antenna structure shown in FIG. 4 at some low frequency $F_{LOW}$ within the antenna operating frequency range.

The middle passive element 106 resonates and operates at frequencies at the lower end of the operating frequency range of antenna structure 100 in the preferred embodiment. When element 106 is physically covered by element 108, the resonant frequency of element 106 drops approximately 8–9% (this change in resonant frequency is also due, in part, to inter-element capacitances). The inter-element parasitic capacitances present when antenna structure 100 is operated at some frequency $F_{LOW}$ at the low end of its range are schematically shown in FIG. 11.

Passive element 106 is excited at $F_{LOW}$ by driver element 104 through parasitic capacitance 160. Actual radiation occurs because of capacitance 166 (from element 106 to ground plane 102). Capacitance 166 is also modelled schematically in FIG. 9 as a parallel RLC circuit. Parasitic capacitor 162 (a series capacitance between passive elements 106 and 108) causes passive element 108 to act as a radiation director, causing a slight increase in gain).

Figure 12:
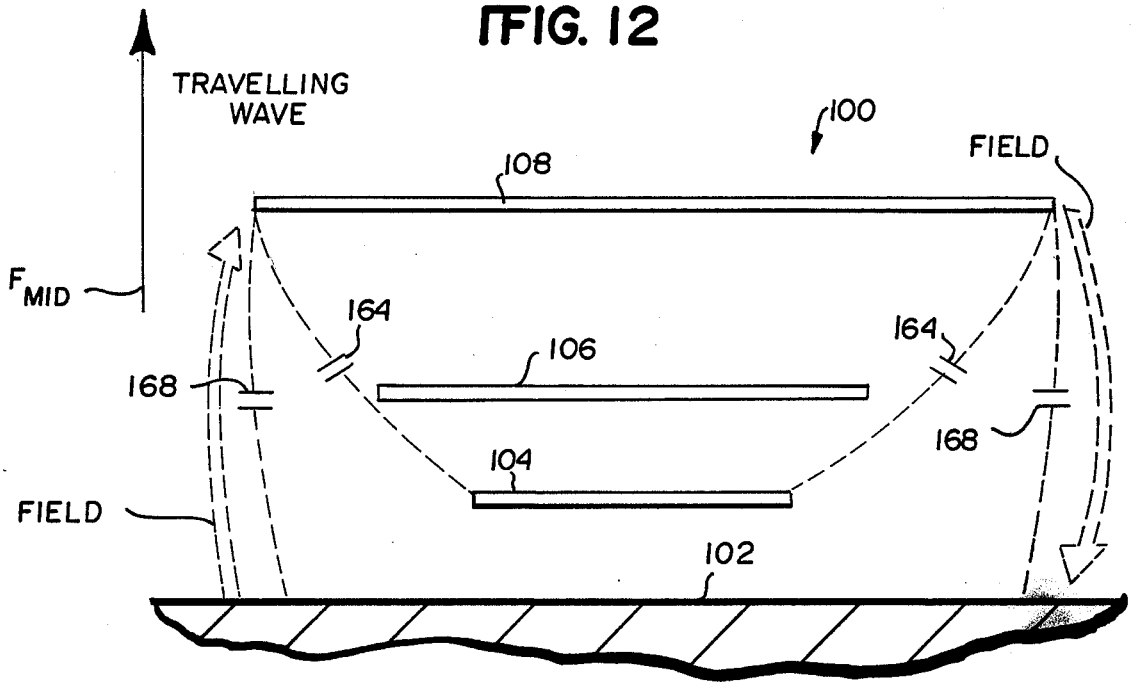
FIG. 12 is a schematic illustration of the effective inter-element capacitances existing in the antenna structure shown in FIG. 4 when the antenna structure is operated at some mid frequency $F_{MID}$ approximately at the middle of its operating frequency range.

FIG. 12 is a schematic diagram of antenna structure 100 showing the inter-element parasitic capacitances present when the antenna structure is operated at some frequency $F_{MID}$ which is approximately in the middle of its operating frequency range. At such middle frequencies, uppermost parasitic element 108 is responsible for most of the radiation emitted from antenna structure 100 in the preferred embodiment. The resonant frequency of uppermost passive element 108 is lowered by approximately 2–3% from its predicted value because it is covered by dielectric radome layer 124.

Element 108 is excited by driven element 104 through parasitic capacitance 164 (between elements 104 and 108). Actual radiation occurs because of the capacitance 168 between element 10S and ground plane 102. Capacitance 168 is also modelled schematically in FIG. 9 as a parallel RLC structure. The midband gain of antenna structure 100 is reduced slightly since there are no elements above element 108 to act as directors.

Figure 13:
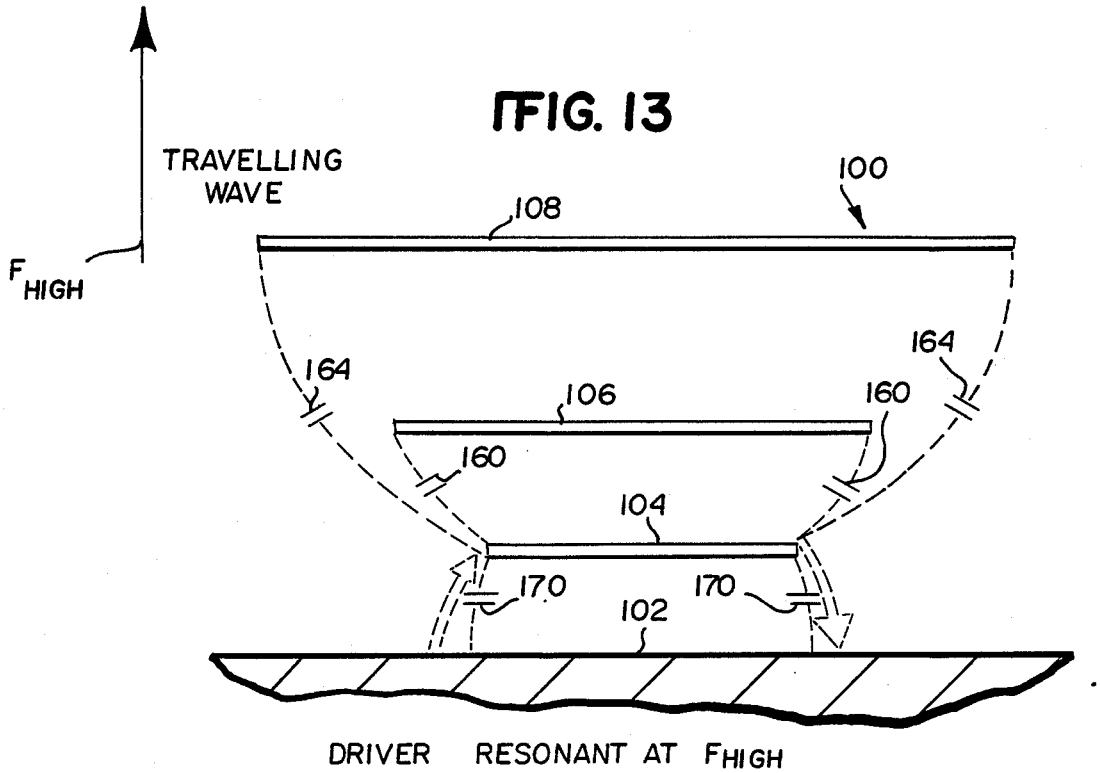
FIG. 13 is a schematic illustration of the effective inter-element capacitances existing in the antenna structure shown in FIG. 4 when the antenna structure is operated at some high frequency $F_{HIGH}$ near the upper end of its operating frequency range.

FIG. 13 is a schematic illustration of antenna structure 100 showing the parasitic inter-element capacitances present when the antenna structure is operated at some frequency $F_{HIGH}$ at the high end of its frequency operating range. Driven element 104 resonates at $F_{HIGH}$ and, because it has elements 104 and 108 directly above it acting as directors, the antenna structure exhibits an overall effective increase in gain. The resonant frequency of driven element 104 is about 8–9% lower than it would be if elements 106 and 108 were not present (inter-element capacitances play a role in this resonant frequency shift). The capacitance 170 between driven element 104 and ground plane 102 is modelled schematically in FIG. 9 by a parallel RLC circuit.

The following TABLE I lists exemplary design specifications for three different embodiments on antenna structure I00: An L Band configuration; an S-Band configuration; and a C-band configuration.

TABLE I

| | L Band (1.7–2.1) GHz) | S-Band (3.5–4.2) GHz) | C-Band (5.3–6.5 GHz) |
|---|---|---|---|
| D | 0.060 | 0.031 | 0.020 |
| $d_1$ | 1.855 | 0.951 | 0.644 |
| $C_1$ | 0.015 | 0.005 | 0.005 |
| $d_2$ | 2.359 | 1.209 | 0.7845 |
| F | 0.375 | 0.165 | 0.113 |
| $C_2$ | 0.015 | 0.015 | 0.015 |
| $d_3$ | 2.690 | 1.336 | 0.840 |
| $E_r$ | 2.44 | 2.17 | 2.17 |
| BW | 17% | 17% | 19% |
| VSWR | 1.5:1 | 1.5:1 | 1.4:1 |

where D=thickness of dielectric layer 110 in inches, $d_1$=diameter of element 104 in inches, $C_1$=thickness of layer 112 in inches, $d_2$=diameter of element 106 in inches, F=thickness of foam layer 114 (71/WF Rhoacell), $C_2$=thickness of layer 124 in inches, $d_3$=diameter of element 108 in inches, $E_r$=the dielectric constants of layers 110, 112 and 124 (which have the same dielectric constants in the preferred embodiment), and BW=the actual measured bandwidth of the antenna structure for the VSWR stated.

As can be seen from TABLE I, there is an indirect relationship between the dimensions and spacing parameters of antenna structure 100 and operating frequency. That is, if the operating frequency is doubled, all spacings and dimensions are cut approximately in half. Thus, approximate parameters for antenna structure 100 for any given operating frequency can be derived from the parameters set forth in TABLE I for an antenna of a different operating frequency.

Thus, if C1=x, then D=4x for any given frequency. Similarly, if $d_3$=y, then $d_2$=0.90y, and $d_1$=0.70y. The dimension D can be varied depending upon desired overall bandwidth (since the bandwidth of the antenna structure is directly dependent on the dimension of D). Thus, D can be increased to greater than 4x if still broader bandwidth is desired and decreased to less than 4x if the antenna does not need to operate over a very wide range of frequencies. However, C1 should be approximately the value described previously for a given operating frequency. The values $d_1$, $d_2$ and $d_3$ are dependent upon the dielectric constants of the composite substrate used, and therefore may have to be adjusted if materials different than those described herein are used.

Figure 14:
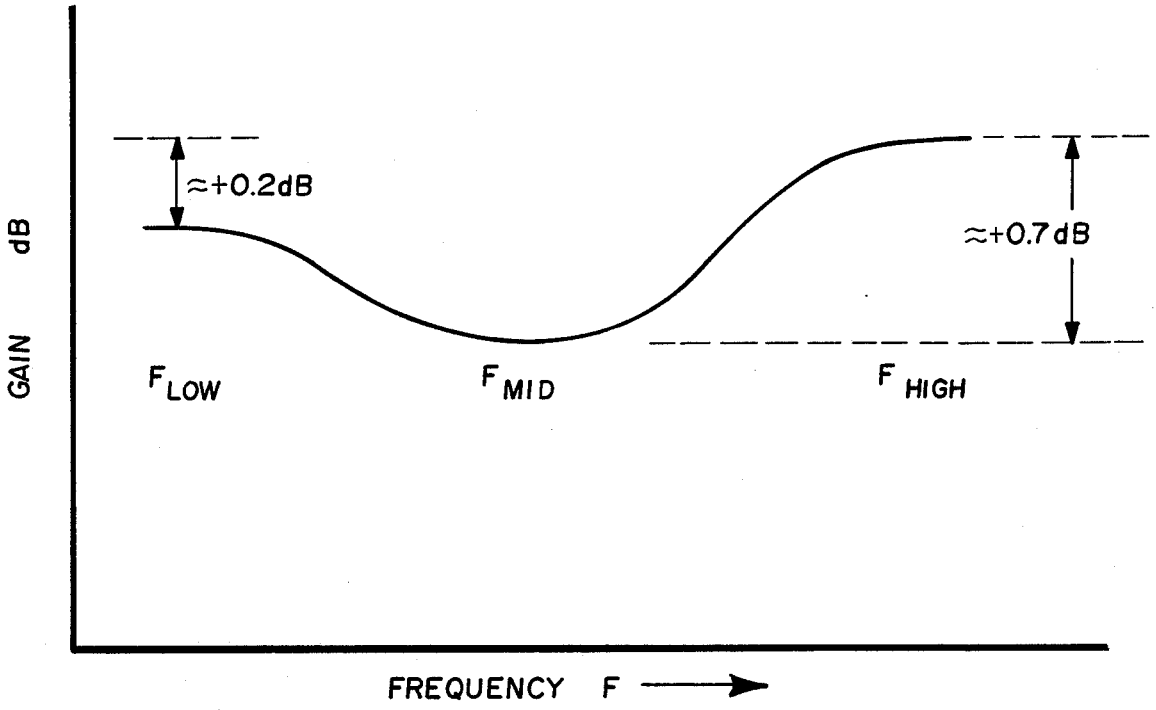
FIG. 14 is a graphical illustration of the gain versus frequency response plot of the antenna structure shown in FIG. 4.

FIG. 14 is a graphical illustration of the gain versus frequency response curve of antenna structure 100. As can be seen, the gain of antenna structure 100 is not constant with frequency, but instead varies due to the director effects of elements 106 and 108 at certain frequencies (as previously discussed).

FIGS. 7 and 8 graphically show the overlapping resonances of elements 104, 106 and 108. FIG. 7 is a plot of the bandwidths of elements 104, 106 and 108 taken individually—that is, as calculated independently for each element using the RL modelling discussed above and assuming there is no interaction between the elements.

FIG. 8 is a plot of the actual frequency vs. VSWR plot of antenna structure 100. Although, as shown in FIG. 7, each element 104, 106 and 108 has relatively sharp resonance curve (determined by the $Q_T$s of the individual elements), these sharp curves "blur together" in the bandwidth plot of the composite antenna structure shown in FIG. 8 due to the interaction between the elements.

Thus, the overall bandwidth of antenna structure 100 for a particular VSWR (e.g., 2.0:1) is substantially greater than the bandwidth which could be obtained by simply connecting without closely coupling the three elements together as in the present invention.

Antenna structure 100 experiences varying degrees of polarization degradation with operating frequency. The amount of degradation depends upon which of elements 104, 106 and 108 is operational. When element 108 is active, the cross-polarized radiation level is at its lowest value for antenna structure 100. However, the cross-polarized radiation level is worse when element 106 is active, and is still worse when element 104 resonates. Even still, antenna structure 100 exhibits isolation between co-polarized and cross-polarized components of approximately −16 dB or better at the highest frequencies within its operating range (i.e., when driven element 104 is resonant).

The change in cross-polarized radiation levels with frequency is easily explained by looking at the physical structure of antenna structure 100 shown in FIG. 4. Driven element 104 has two elements above it, and passive element 106 has one element above it. These upper elements cause changes in polarization purity—more for driven element 104 (because there are two elements above it) than for element 106 (which has only one element above it). In other words, energy radiated from the lowermost element is disturbed by the close proximity of non-resonant elements in the direction of propagation.

Antenna structure 100 as described forms an "inverted stack" (that is, the element having the smallest dimension is lowermost in the stack). This inverted stack structure has the advantage that very little "real estate" on dielectric layer surface 110*a* (of PC board structure 126) is occupied by lowermost element 104, leaving room for additional RF circuitry (for example, a power dividing network) to be etched on laminate surface 110*a*. It is inexpensive and relatively simple to fabricate whatever additional RF circuitry is desired on laminate surface 110*a*, thus providing additional features in the same size antenna package and obviating the need for externally-provided RF circuitry.

Further advantages are obtained from the feature that the lowermost element 104 is directly connected to a transmission line and serves as the driven element (thereby obviating the need for feed-throughs and the like). If no additional RF circuitry is to be provided on lowermost PC board structure 126, it may be desirable in some instances to make the dimensions of driven element 104 larger than the dimensions of one or both of elements 106 and 108. For example, it might be desirable to select the dimensions of driven element 104 so that the driven element resonates at the middle of the frequency operating range of the antenna structure, and to make element 106 larger than elements 104 and 108 (so that middle element 106 resonates at lower end of the frequency range and uppermost element 108 resonates at the upper end of the frequency range). This configuration has been experimentally verified to have a 1.8 VSWR bandwidth of about 23%. However, in order to optimize antenna structure 100 to enable etching of an array power divider on the same substrate as that supporting driven element 104, the resonant frequency of the driven element was changed from midband to $F_{HIGH}$ in the preferred embodiment.

While the present invention has been described with what is presently considered to be the most practical and preferred embodiments, it is to be understood that the appended claims are not be limited to the disclosed embodiments but on the contrary, are intended to cover all modifications, variations and equivalent arrangements which retain any of the novel features and advantages of this invention.

What is claimed is:

1. A broadbanded microstrip antenna comprising:

a conductive reference surface;

a driven conductive RF radiator element spaced less than one-tenth of a wavelength above said reference surface;

a conductive RF feedline connected to said driven element;

a first passive conductive RF radiator element spaced above and capacitively coupled to said driven element, said first passive element being electrically isolated from said driven element and said conductive reference surface; and a second passive conductive RF radiator element spaced above said first passive element and capacitively coupled to said driven element, said second passive element being electrically isolated from said driven element and said conductive reference surface, wherein the sizes of said driven, first and second elements, the spacings between said driven, first and second elements, and the Quality factors of said driven, first and second elements are dimensioned to account for inter-element capacitance between said driven element, first passive element and second passive conductive elements and said antenna resonates over a wide, substantially continuous band of frequencies, said driven element being effectively coupled in series by inter-element capacitance with said first and second passive elements, said first and second passive elements being effectively coupled in parallel with one another by inter-element capacitance.

2. An antenna as in claim 1 wherein the spacings between said elements and the sizes of said elements are dimensioned to provide a 2:1 VSWR bandwidth of at least 20%.

3. An antenna as in claim 1 wherein said driven element resonates at a frequency which is higher than the resonant frequencies of said first and second passive elements.

4. An antenna as in claim 1 further including a substrate having a first surface, said driven element and at least one RF circuit being disposed on said substrate first surface.

5. An antenna as in claim 4 wherein said substrate also has a second surface opposing said first substrate surface, said second surface being disposed in contact with said reference surface, said substrate spacing said driven element from said reference surface.

6. A broadbanded microstrip antenna as in claim 1 further comprising a radome disposed above said second passive element.

7. A broadbanded microstrip antenna as in claim 1 wherein the resonant frequency ranges of said first and second passive elements overlap.

8. A broadbanded microstrip antenna as in claim 1 wherein said driven element dimensions are smaller than said first passive element dimensions.

9. A broadbanded microstrip antenna as in claim 8 wherein said first passive element dimensions are smaller than said second passive element dimensions.

10. An antenna as in claim 9 wherein said first passive element resonates at a lower frequency than said second passive element.

11. An antenna as in claim 10 wherein said driven element and said second passive element both resonate at some frequencies between the middle and the upper end of said continuous frequency band.

12. A broadbanded microstrip antenna as in claim 1 wherein said first and second passive elements are only parasitically coupled to said driven element.

13. A broadbanded microstrip antenna as in claim 1 wherein said antenna has a VSWR of no more than 1.8 over a 23% frequency range, and said antenna has greater gain at the lower and higher ends of said range than in the middle of said range.

14. A broadbanded microstrip antenna as in claim 1 wherein said first and second parasitic elements direct RF radiation emanating from said driven element.

15. An antenna as in claim 1 wherein said conductive reference surface acts as a ground plane for all of said driven, first and second elements over said entire band of frequencies.

16. A broadbanded microstrip antenna comprising:

a conductive reference surface;

a driven conductive RF radiating element spaced less than one-tenth of a wavelength above said reference surface, said driven element dimensioned to resonate in response to signals within a first band of radio frequencies;

a conductive RF feedline connected to said driven element;

a first passive conductive RF radiating element spaced above and only parasitically coupled to said driven element, said first passive element dimensioned to resonate in response to signals within a second band of radio frequencies, said first passive element effectively connected in series with said driven element through capacitive coupling with said driven element; and a second passive conductive RF radiating element spaced above said first passive element and only parasitically coupled to said driven element, said second passive element dimensioned to resonate in response to signals within a third band of radio frequencies, said second passive element effectively connected in series with said driven element through capacitive coupling and effectively connected in parallel with said first passive element through capacitive coupling with said first element, wherein said first, second and third bands are different from and overlap one another, said elements are arranged in a stack, and said driven, first and second elements are dimensioned such that inter-element capacitive coupling is accounted for by said driven, first and second element dimensions and said antenna is resonant over a substantially continuous band of frequencies wider than the sum of said first, second and third radio frequency bands.

17. A broadband microstrip antenna as in claim 16 wherein said driven element, first passive element and second passive element are closely coupled to and interact with one another such that the composite resonant frequency bandwidth of said elements is substantially continuous and is substantially broader than the combination of independent resonant frequency bandwidths of said individual elements operating independently.

18. A broadband microstrip antenna as in claim 16 wherein:

said second passive element directs radiation emitted by said first passive element and/or said driven element when an RF signal within said first or second bands is applied to said feedline; and said first and second passive elements direct radiation emitted by said driven element when an RF signal within said first band is applied to said feedline.

19. An antenna as in claim 16 wherein said first passive element is larger than said second passive element and said second radio frequency band is higher than said third radio frequency band.

20. An antenna as in claim 19 wherein said driven element and said second passive element both resonate at some frequencies between the middle and the upper end of said continuous frequency band.

21. A broadband microstrip antenna comprising:

a conductive reference surface;

a first dielectric layer disposed on said reference surface;

a first discoid conductive element disposed on said first dielectric layer, said first element having a diameter of approximately 0.7 y;

a second dielectric layer disposed on said first element, said second layer having a thickness x;

a second discoid conductive element disposed on said second layer, said second element having a diameter of approximately 0.9 y;

a further dielectric layer disposed on said second element;

a third discoid conductive element disposed on said third layer, said third element having a diameter y; and RF transmission line means connected between said reference surface and said first element for coupling RF signals to and/or from said first element, wherein said second element resonates at a lower frequency than said third element.

22. An antenna as in claim 21 wherein said antenna is resonant over a wide, substantially continuous band of radio frequencies and said first and third elements both resonate at some frequencies between the middle and the upper end of said substantially continuous radio frequency band.

23. A broadband microstrip antenna comprising:

a conductive reference surface;

a first dielectric layer disposed on said reference surface and having a thickness D;

a first discoid conductive element disposed on said first dielectric layer, said first element having a diameter within the range of 0.60 inches and 1.90 inches;

a second dielectric layer disposed on said first element, said second layer having a thickness within the range of 0.005 inches and 0.015 inches;

a second discoid conductive element disposed on said second layer, said second element having a diameter within the range of 0.75 inches and 2.4 inches;

a third dielectric layer disposed on said second element, said third layer having a thickness within the range of 0.110 inches and 0.375 inches;

a third discoid conductive element disposed on said third layer, said third element having a diameter within the range of 0.840 inches and 2.70 inches; and RF transmission line means connected between said reference surface and said first element for coupling RF signals to and/or from said first element.

24. An antenna as in claim 23 wherein:

said first, second and third layers have thicknesses of approximately 0.060, 0.015 and 0.375 inches, respectively;

said first, second and third elements have diameters of approximately 1.855, 2.359 and 2.690 inches, respectively; and said antenna operates over the frequency range of 1.7 GHz to 2.1 GHz.

25. An antenna as in claim 23 wherein:

said first, second and third layers have thicknesses of approximately 0.030, 0.005 and 0.165 inches, respectively;

said first, second and third elements have diameters of approximately 0.951, 1.209 and 1.336 inches, respectively; and said antenna operates over the frequency range of 3.5 GHz to 4.2 GHz.

26. An antenna as in claim 23 wherein:

said first, second and third layers have thicknesses of approximately 0.020, 0.005 and 0.113 inches, respectively;

said first, second and third elements have diameters of approximately 0.644, 0.7845 and 0.840 inches, respectively; and said antenna operates over the frequency range of 5.3 GHz to 6.4 GHz.

27. An antenna as in claim 23 wherein said first, second and third elements are parallel to one another and to said reference surface, and the centers of said first, second and third elements lie substantially along a common axis normal to said reference surface.

28. An antenna as in claim 23 wherein said antenna has a 1.5:1 VSWR bandwidth of at least 15%.

29. An antenna as in claim 23 wherein at least one and no more than two of said first, second and third elements are dimensioned at any arbitrary frequency within design operating radio frequency range.

30. An antenna as in claim 23 wherein said second and third elements are effectively connected in parallel.

31. An antenna as in claim 23 further including a radome disposed on said third element.

32. An antenna as in claim 23 wherein said second element resonates at a lower frequency than said third element.

33. An antenna as in claim 32 wherein said antenna is resonant over a wide, substantially continuous band of radio frequencies and said first and third elements both resonate at some frequencies between the middle and the upper end of said substantially continuous radio frequency band.

34. A process for producing a broadband microstrip antenna comprising the steps of:

(1) providing a first layer of dielectric laminate having first and second conductive layers adhered to opposing surfaces thereof, said first conductive layer being resonant at a frequency $F_{HIGH}$;

(2) connecting said first and second conductive layers to center and ground connections, respectively, of an RF transmission line;

(3) providing a second layer of dielectric laminate having a third conductive layer resonant at a frequency $F_{LOW}$ lower than said frequency $F_{HIGH}$ adhered to a first surface thereof, said second layer having an insulative surface opposing said first surface;

(4) disposing said second layer insulative surface on said second conductive layer;

(5) disposing a third layer of insulative material on said third conductive layer;

providing a further layer of dielectric laminate having a fourth conductive layer resonated at a third frequency $F_{MID}$ between said frequencies $F_{HIGH}$ and $F_{LOW}$ adhered to a surface thereof; and bonding said further layer surface and/or said fourth conductive layer to said third insulative material layer.

35. A broadbanded microstrip antenna comprising:

a conductive reference surface;

a driven conductive microstrip patch RF radiator element above said reference surface;

a conductive RF feedline connected to said driven element; a first planar passive conductive RF radiator element spaced above and capacitively coupled to said driven element and resonating about a first frequency; and a second planar passive conductive RF radiator element spaced above said first passive element and capacitively coupled to said driven element, said second element having a larger surface area than said first element surface area and resonating about a frequency higher than said first frequency, wherein said driven, first and second elements are dimensioned such that inter-element capacitance is optimized and said antenna is resonant over a wide, substantially continuous band of frequencies.

* * * * *